US006452471B1

(12) United States Patent
Byun et al.

(10) Patent No.: US 6,452,471 B1
(45) Date of Patent: Sep. 17, 2002

(54) COLOR PURITY AND COVERGENCE MAGNET FOR COLOR CATHODE RAY TUBE

(75) Inventors: Soo Ryong Byun, Kyungsangbuk-do (KR); Kwang Jun Lee, Kyungsangbuk-do (KR)

(73) Assignee: Orion Electric Co., Ltd., Kyungsangbuk-do (KR)

( * ) Notice: Subject to any disclaimer, the term of this patent is extended or adjusted under 35 U.S.C. 154(b) by 0 days.

(21) Appl. No.: 09/544,888

(22) Filed: Apr. 7, 2000

(30) Foreign Application Priority Data

Apr. 12, 1999 (KR) ..... 99-12867

(51) Int. Cl.[7] ..... H01J 29/70
(52) U.S. Cl. ..... 335/210; 335/212
(58) Field of Search ..... 335/210–214, 335/302, 306; 313/412, 431, 440

(56) References Cited

U.S. PATENT DOCUMENTS 3,808,570 A * 4/1974 Thompson et al. ..... 335/212
5,148,138 A * 9/1992 Miyata et al. ..... 335/302
5,399,933 A * 3/1995 Tsai ..... 313/431

* cited by examiner

*Primary Examiner*—Ramon M. Barrera
(74) *Attorney, Agent, or Firm*—Notaro & Michalos PC

(57) ABSTRACT

Disclosed a color purity and convergence magnet (PCM) for a color cathode ray tube capable of fine-adjusting irrespective of the position of the axial direction of the tube, reducing the influence of an adjusting magnetic field on an electron gun, and increasing the workability for the color cathode ray tube. The color purity and convergence magnet for a color cathode ray tube comprising an inner ring magnet and an outer ring magnet being mounted at the outer circumference of a neck portion in the tube and arranged externally and internally in a radial direction on the same surface orthogonal to the tube axis so as to adjust the static characteristics of the color purity and convergence, wherein a magnetizing force of the same number of poles such as two-pole, four-pole and six-pole is formed at the same angle of the circumference is characterized in that the inner surface of the inner ring magnet is magnetized, and the magnetizing force of the inner ring magnet is smaller than that of the outer ring magnet in a strength.

4 Claims, 12 Drawing Sheets

COLOR PURITY AND COVERGENCE MAGNET FOR COLOR CATHODE RAY TUBE

BACKGROUND OF THE INVENTION

1. Field of the Invention

The present invention relates to a color purity and convergence magnet for adjusting the static characteristics of the color purity and convergence of a color cathode ray tube and, more particularly to a color purity and convergence magnet capable of fine-adjusting the running paths of the electron beams irrespective of the position of the axial direction of the tube, reducing the influence of its adjusting magnetic field on the electron beams and improving the workability when manufacturing the color cathode ray tube.

2. Description of the Background Art

Generally, in a color cathode ray tube having an electron gun with a structure of in-line arrangement, a color purity and convergence magnet (PCM) is composed of two-pole, four-pole and six-pole magnets. The two-pole magnet adjusts the color purity, the four-pole magnet adjusts the mutual position of two outer electron beams, that is, R/B electron beams, and the six-pole magnet adjusts the mutual position of a central electron beam and two outer electron beams, that is, R/G and B/G electron beams, thereby adjusting the static characteristics of the color purity and convergence of the color cathode ray tube. Each of these magnets is formed in a pair in order to adjust finely the color purity and convergence.

A four-pole magnet widely utilized in the conventional art is illustrated in FIG. 1 and FIGS. 2*a* through 2*b*. As illustrated therein, the four-pole magnet consists of a pair of front and rear rings 11 and 12 having a predetermined width. As illustrated in FIG. 1, the front and rear rings 11 and 12 are mounted on the neck portion 1 of the tube in a longitudinal direction of the cathode ray tube. The rear ring 12 is formed to have a magnetic field about 1.1~1.3 times stronger than that of the front ring 11. The two-pole and six-pole magnets are formed in the same manner. This difference between the magnetic fields formed at the front and rear rings 11 and 12 is obtained by considering components of velocity acquired when electrons are accelerated in the electron gun.

However, such configuration is disadvantageous for the following reasons. Firstly, since a pair of magnets on which a certain magnetic field is formed influence the electron beams differently depending on their position, an optimum adjustment may be made only at a position corresponding to the difference between the magnetic fields formed at the front and rear rings 11 and 12.

Secondly, since a certain magnetic field was already formed in each of the front and rear rings, it influences the electron beams even in the case that adjustment is not required.

In other words, at any random position at which a composite magnetic field in front-rear arrangement is accelerated from the axial direction of the tube to the screen direction, the magnetic field cannot be close to zero and thus this adjustment becomes difficult. Generally, two-pole, four-pole and six-pole magnetic fields or electric fields have a problem of distorting the shape of electron beams. Among them, the four-pole magnetic field is most fatal. Moreover, there is another problem that it is difficult to achieve the fine adjustment required in an ITC process of combining a cathode ray tube and a deflection yoke.

In order to solve the above problems, Japanese patent application laid-open publication No. Sho 51-65830 (Jun. 7, 1976) discloses a magnetic beam adjusting device for use in a cathode ray tube that is not arranged forward and backward in a longitudinal direction of the tube, but arranged to overlap in a radial direction as illustrated in FIGS. 3 and 4.

In the conventional beam adjusting device as illustrated in FIGS. 3 and 4, two four-pole ring-shaped magnets 1A and 1B in a pair are formed, for example, by using a binder made of rubber and synthetic resin and injecting powdered magnet material such as barium ferrite into the binder. The pair of magnets have different inner diameters and are combined in a state in which they are double-sided in and out, with one direction at the inner side and the other direction at the outer side, and relative rotation is freely performed. To ensure this combination, a flange 2 is formed at one end of the inner ring-shaped magnet 1A, and the outer ring-shaped magnet 1B is fixedly fitted to a step portion formed along the outer circumferential surface of the flange 2.

This pair of ring-shaped magnets 1A and 1B are mounted on the neck portion of the picture tube, and both magnets 1A and 1B are positioned at the same surface orthogonal to the tube axis. Both ring-shaped magnets 1A and 1B have four magnetic poles arranged at the same interval from each other in a circumferential direction, with alternating polarity. These magnetic fields are installed at the outer surface of the inner ring-shaped magnet 1A and at the inner surface of the outer ring-shaped magnet 1B, so that they are opposed to the surface of contact between the inner and outer ring-shaped magnets 1A and 1B. Herein, the reference numerals 3 and 4 indicate hand levers for rotation control of the ring-shaped magnets 1A and 1B, respectively.

By this construction, the magnetic field in the tube can be remained in a zero state, thereby an accurate adjustment becomes possible, leakage flux minimally influences on the interior of the picture tube, and, further, the length in the axial line direction can be decreased.

In addition, as an example of an another conventional art, Japanese patent application laid-open publication No. Hei 4-181638 (Jun. 29, 1992) discloses a convergence purity correction apparatus as illustrated in FIGS. 5*a*–5*c* and FIG. 6.

In FIGS. 5*a* and 5*b*, a two-pole magnet 40A and a four-pole magnet 40B are combined on the same surface. For this reason, the axial length for a pair of ring magnets is decreased, and the back space for a deflection yoke can be set as large as the decreased length as compared to the conventional art. Thus, it is possible to sufficiently back the deflection yoke toward the electron gun assembly during color purity adjustment for the cathode ray tube, and it is easy to perform the color purity adjustment.

Also, in a composite ring magnet 40A as illustrated in FIG. 6, a two-pole magnet 40A1 having an inner diameter larger than that of a ring type four-pole magnet 40B having almost the same inner and outer diameters as in the conventional art is co-axially attached to the same surface as the four-pole magnet 40B, with a rotary ring 40D1 intercalated to the outer diameter of the four-pole magnet 40B, and another two-pole magnet 40A2 is co-axially attached to the same surface as the four-pole magnet 40B and the two-pole magnet 40A1, with a rotary ring 40D2 intercalated to the outer diameter of the two-pole magnet 40A1.

In this structure, the rotary rings 40D1 and 40D2 are constructed in such a manner that they can rotate freely, independently and smoothly, being interlocked with an H-type sphere at the inner and outer diameter portions of the rotary rings 40D1 and 40D2 and a protruding portion formed at the inner and outer diameter portions of the four-pole magnet 40B and the two-pole magnets 40A1 and 40A2. In a ring portion at the outer diameter of the two-pole magnets 40A1 and 40A2 and four-pole magnet 40B, respective hand levers are constructed such that they are formed as a single body to thereby perform rotation adjustment conveniently.

By the construction as above described in which the two-pole magnets and the four-pole magnet are combined and the two-pole magnets are arranged at the outer sides of the four-pole magnet, a back space for the deflection yoke can be obtained, and the axial length of the magnetic correcting device can be reduced. Moreover, by enlarging the inner diameter of the two-pole magnet, a parallel uniform magnetic field can be obtained in a region where electron beams exist, thereby eliminating the deformation of a section of an electron beam spot and preventing degradation in focus characteristics.

In addition, the construction of a magnetic correction device for use in a cathode ray tube as disclosed in Japanese patent application laid-open publication Nos. Sho 50-12964 (Feb. 10, 1975) and Sho 50-57725 (May 20, 1975) is illustrated in FIGS. 7*a* through 7*b*.

In FIGS. 7*a* and 7*b*, the magnetic correction device for use in a cathode ray tube is characterized in that, in a magnetic correction apparatus provided with: at least one support member 47 made of nonmagnetic material; a fixing member for fixing the support member to the neck portion of the cathode ray tube; and at least one pair of coaxial rings with magnetic poles distributed and arranged adjacent their borders for thereby mounting the coaxial rings on the electric support member and at the same time controlling the passage of electron beams generated from the cathode ray tube wherein rotation is freely performed in the opposite direction while centering around the axis of the rings, the inner diameter of a ring 43 at one side of a pair of coaxial rings is set larger than the outer diameter of a ring 45 at the other side, the small-diameter ring 45 is mounted on the large-diameter ring 43, a saw tooth 49 is installed at the inner circumferential surface of the outer-diameter ring 43, a saw tooth 51 is installed at the outer diameter of the inner-outer ring 45, and at least one pinion 53 capable of rotating around a spindle 55 fixed to the electric support member 47 and at the same time corresponding to the saw teeth 49 and 51 is arranged in a space portion between both rings 43 and 45.

By this construction, the axial dimension of the correction apparatus can be reduced, and the strength of a magnetic field is easily adjustable by automatically rotating the inner ring in the reverse direction by rotation of the outer ring.

In the above-described constructions in the conventional art, the workability for manufacturing the color cathode ray tube can be increased because the elements are arranged to overlap with each other in the radial direction of the cathode ray tube. However, there arises problem that it is not easy to form a magnetic pole on the outer surface compared to the inner surface, it is impossible to perform fine adjustment according to the difference between the amounts of magnetization toward the inner surface and outer surface because it is difficult to control each of the amounts of magnetization, and the influence of a magnetic field on electron beams cannot be reduced.

SUMMARY OF THE INVENTION

Accordingly, in order to overcome the above-described problems, it is an object of the present invention to provide a color purity and convergence magnet for a color cathode ray tube that can form a zero composite magnetic field capable of satisfying the minimum amount of beam movement and finely adjust the speed and distortion degree of beams on any position on the tube axis by minimizing the magnet's influence on the beams, when the magnet is mounted on a certain position at the neck portion. Also, the object of the present invention is to provide a color purity and convergence magnet for a color cathode ray tube that can shorten the neck portion even in a large-sized cathode ray tube and largely improve the workability in neck portion during a fabrication process of the cathode ray tube.

In order to achieve the above object, in accordance with the present invention, A color purity and convergence magnet for a color cathode ray tube comprising an inner ring magnet and an outer ring magnet being mounted at the outer circumference of a neck portion in the tube and arranged externally and internally in a radial direction on the same surface orthogonal to the tube axis so as to adjust the static characteristics of the color purity and convergence, wherein a magnetic force of the same number of poles such as two-pole, four-pole and six-pole is formed at the same angle of the circumference is characterized in that the inner surface of the inner ring magnet is magnetized, and the magnetizing force of the inner ring magnet is smaller than that of the outer ring magnet in a strength.

It is preferable that the outer ring magnet is magnetized to its inner surface, and the magnetization intensity of the outer ring magnet is $M_0=(\alpha^2/\beta)M_I$ with respect to the magnetization intensity of the inner ring magnet (herein, $\alpha$ is $R_0/R_I$, $\beta$ is $V_0/V_I$, $R_I$ is the internal radius of the inner ring magnet, $R_0$ is the internal radius of the outer ring magnet 22, $V_I$ is the magnetic volume of the inner ring magnet, and $V_0$ is the magnetic volume of the outer ring magnet). The adjusting hand lever of the inner ring magnet can be formed to protrude outwardly in a radial direction, being protruded in the axial direction of the tube from one surface vertical to a tube axis of the inner ring magnet, and the adjusting hand lever of the outer ring magnet can be formed to protrude from the outer circumferential surface of the outer ring magnet so that it is close to the adjusting hand lever of the inner ring magnet, when combined with the inner ring magnet.

In addition, it is configurable that the amount of electron beams movement is less than 0.5 mm, when the outer ring magnet and inner ring magnet are arranged so that magnetizing force of the opposite polarity corresponds towards the radial direction.

BRIEF DESCRIPTION OF THE DRAWINGS

The present invention will become better understood with reference to the accompanying drawings, which are given only by way of illustration and thus are not limitative of the present invention, wherein.

DETAILED DESCRIPTION OF THE PREFERRED EMBODIMENTS

Hereinafter, the preferred embodiment of the present invention will now be described with reference to the accompanying drawings.

Figure 8:
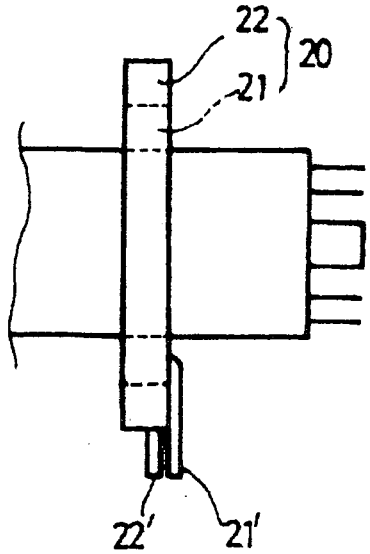
FIG. 8 is a front view illustrating an embodiment of a color purity and convergence magnet for a color cathode ray tube in accordance with the present invention.
Figure 9:
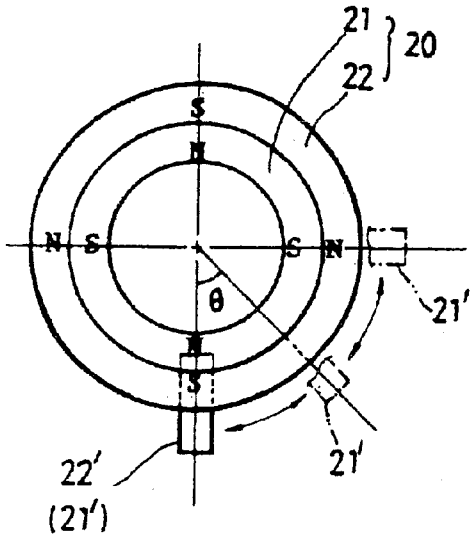
FIG. 9 is a plan view of a magnet of FIG. 8.
Figure 10A:
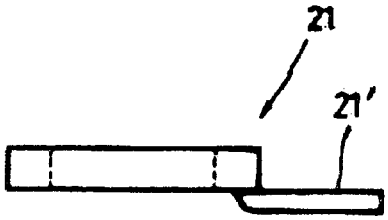
FIGS. 10*a* and 10*b* are front and plan views of an inner ring magnet and FIGS. 10*c* and 10*d* are front and plan views of an outer ring magnet, respectively.
Figure 10B:
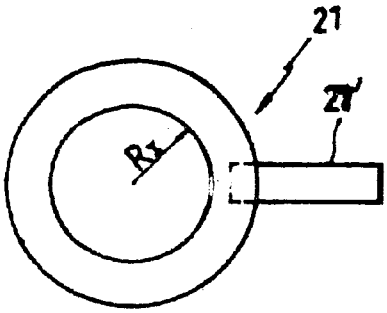
Figure 10C:
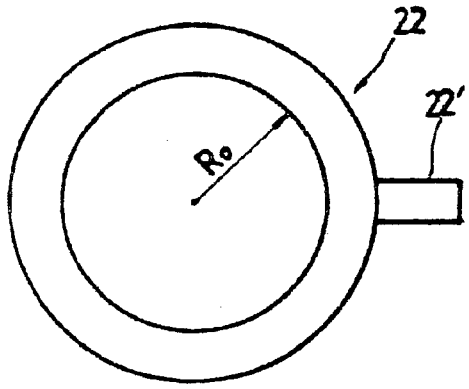
Figure 10D:
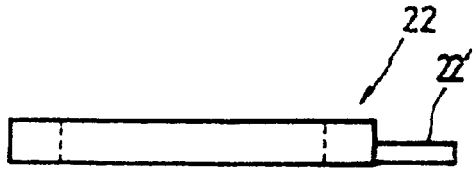

FIG. 8 illustrates a front view of an embodiment of a color purity and convergence magnet for a color cathode ray tube in accordance with the present invention, FIG. 9 illustrates a plan view of a magnet of FIG. 8, and FIGS. 10*a* and 10*b* illustrate front and plan views of an inner ring magnet and FIGS. 10*c* and 10*d* are front and plan views of an outer ring magnet, respectively.

As illustrated in FIGS. 8 through 10*d*, the color purity and convergence magnet for the color cathode ray tube using permanent magnets comprises two sheets of outer ring magnet 22 and inner ring magnet 21 of the same number of poles formed in a pair. The inner ring magnet 21 and outer ring magnet 22 are combined to overlap with each other in a radial direction on the same surface orthogonal to the tube axis.

A magnetic pole having the same number of poles is formed on the inner surface respectively of the outer ring magnet 22 and the inner ring magnet 21 so that the magnetization intensity $M_I$ of the inner ring magnet 21 is smaller than that of the magnetization intensity $M_0$ of the outer ring magnet 22.

The adjusting hand lever 21' of the inner ring magnet 21, as illustrated in FIG. 8 and FIGS. 10*a* and 10*b*, is formed to protrude outwardly in a radial direction, being protruded toward the axial direction of the tube from one surface vertical to the tube axis of the inner ring magnet 21. The adjusting hand lever 22' of the outer ring magnet 21, as illustrated in FIGS. 8, 9, 10*c* and 10*d*, is formed to protrude from the outer circumferential surface of the outer ring magnet 22 so that it is close to the adjusting hand lever 21' of the inner ring magnet 21, when combined with the inner ring magnet.

In the present invention thus constructed, the color purity and convergence magnet consists of two-pole, four-pole and six-pole magnets.

Figure 11:
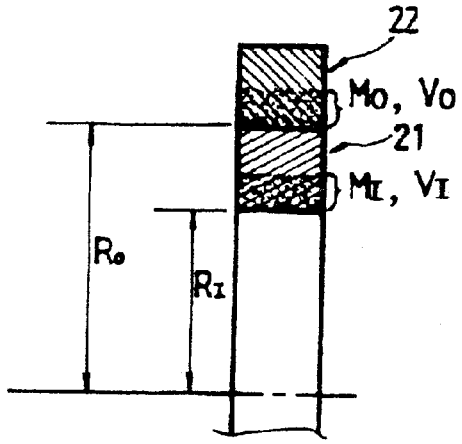
FIG.11 is a schematic cross-sectional view illustrating a magnetization structure of an inner ring magnet and an outer ring magnet.
Figure 12A:
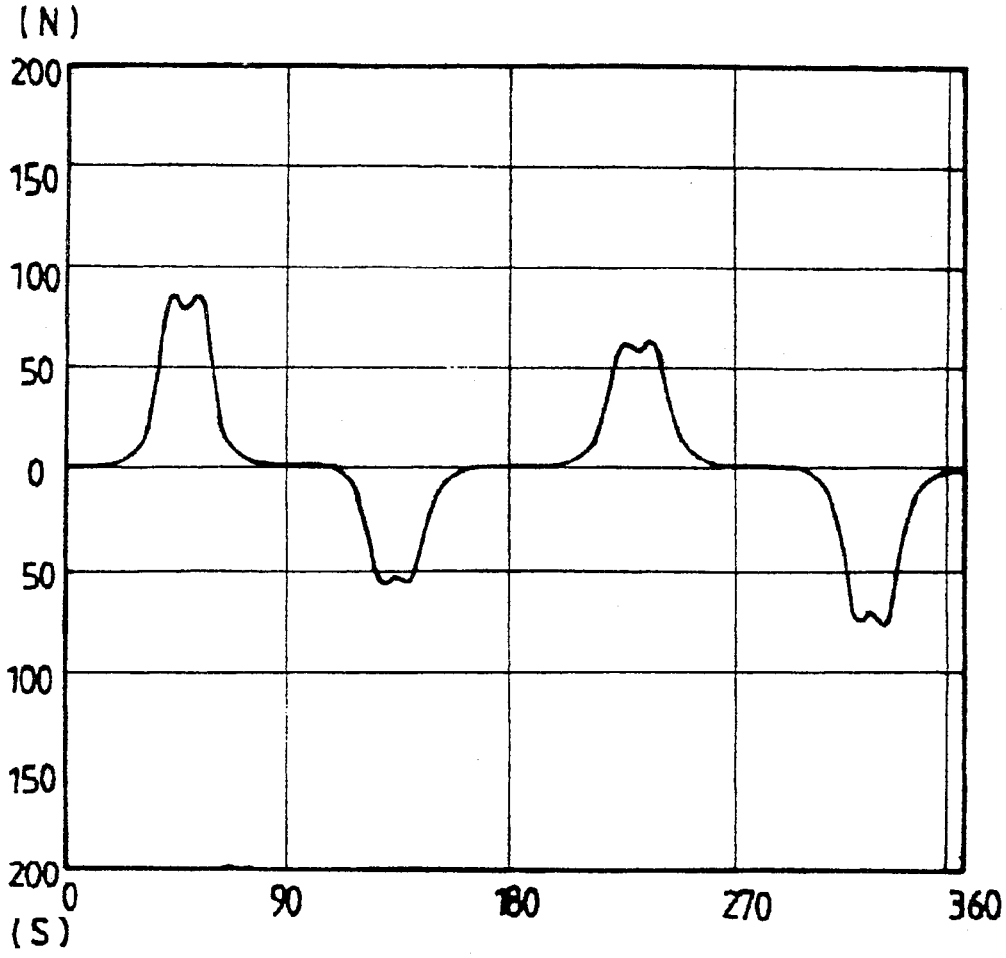
FIGS. 12*a* and 12*b* are graphs illustrating a good state of magnetization in accordance with the present invention.
Figure 12B:
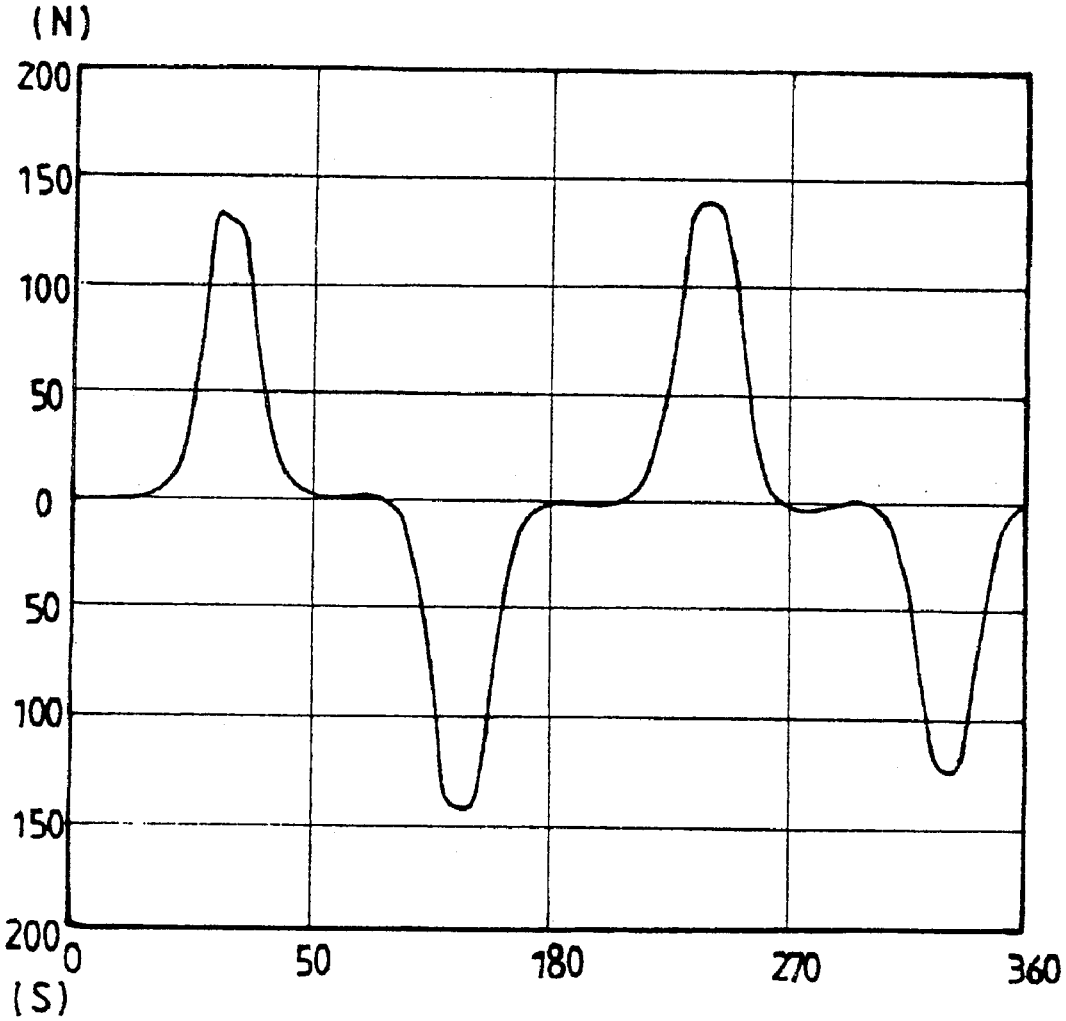
Figure 13A:
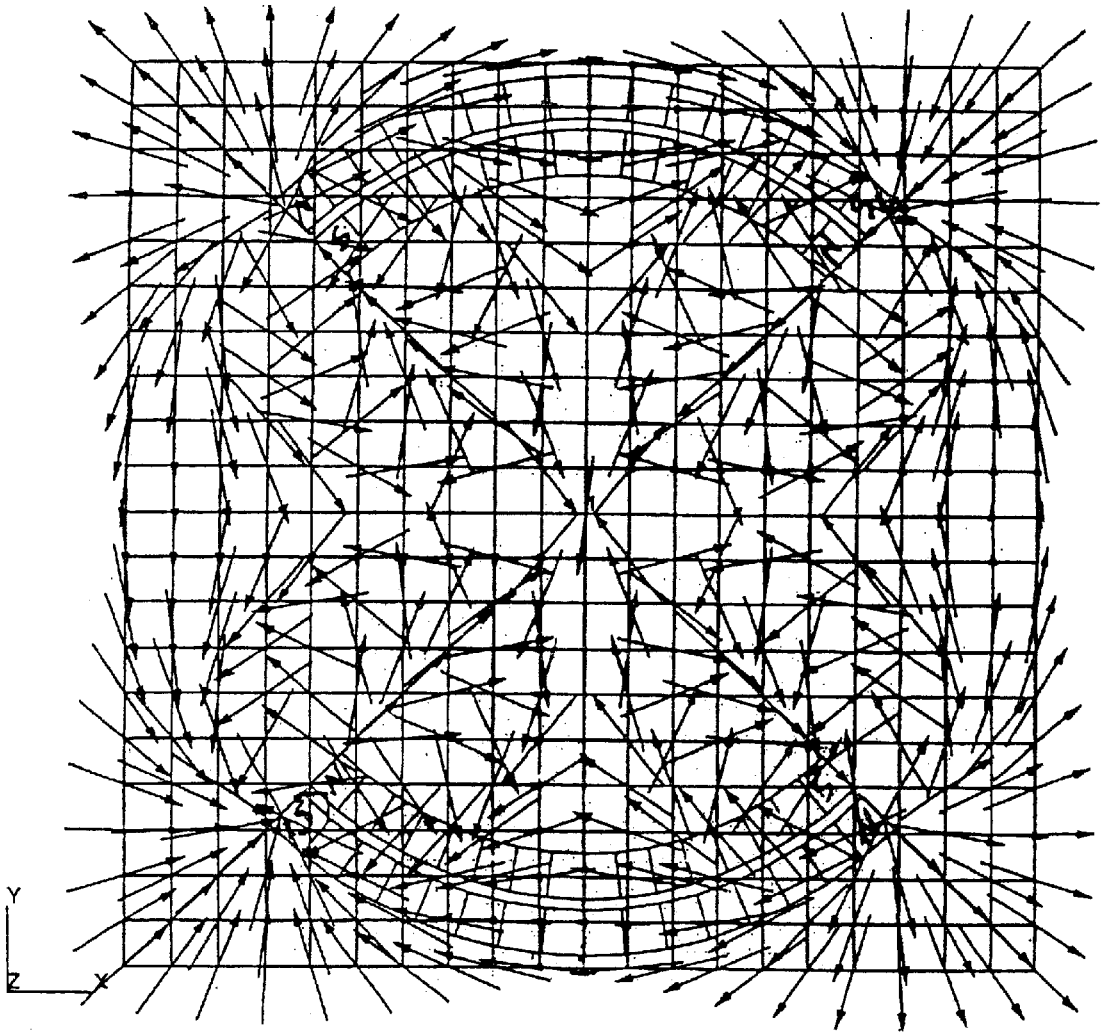
FIGS. 13*a* through 13*c* are vector diagrams illustrating the strength of a magnetic field according to a relative rotation angle of a magnet in accordance with the present invention.
Figure 13B:
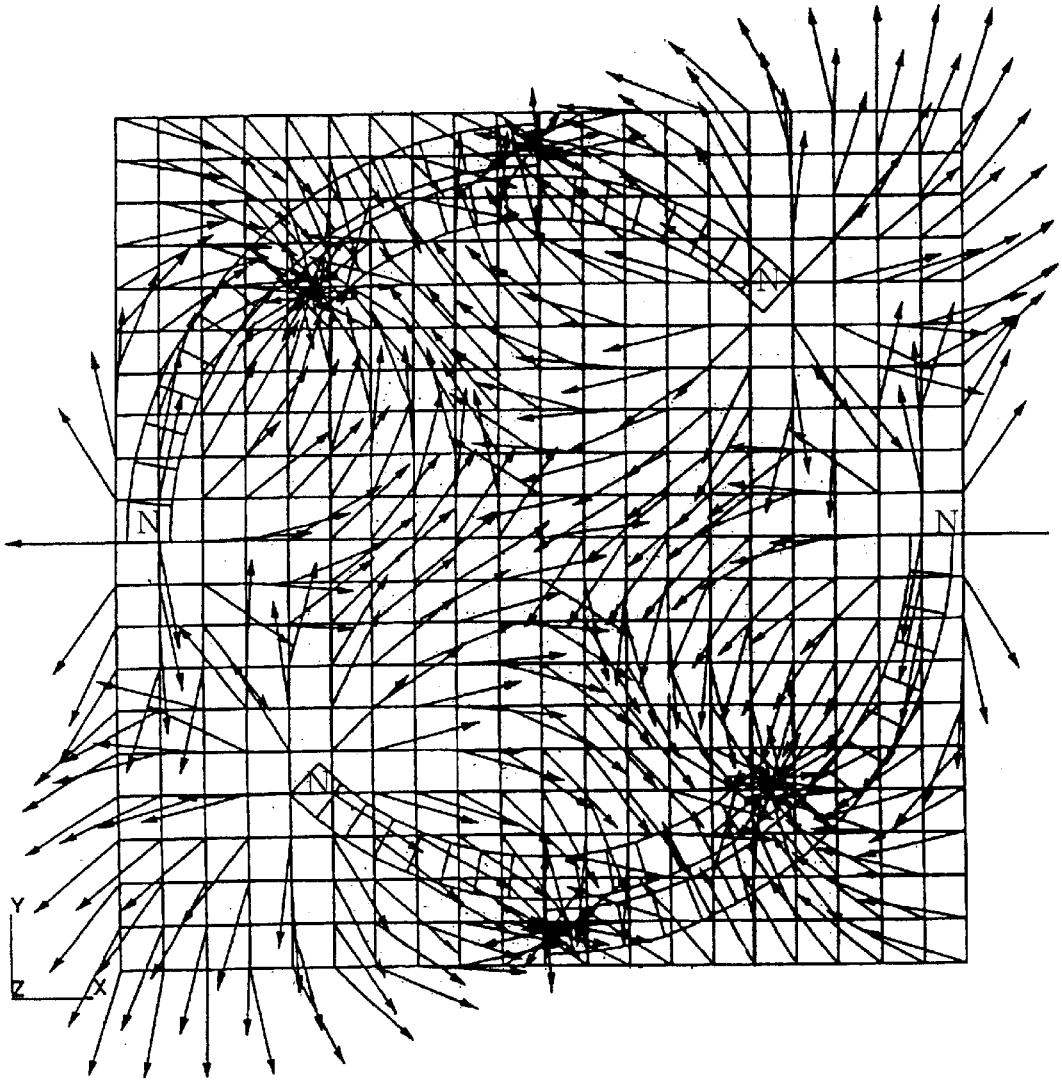
Figure 13C:
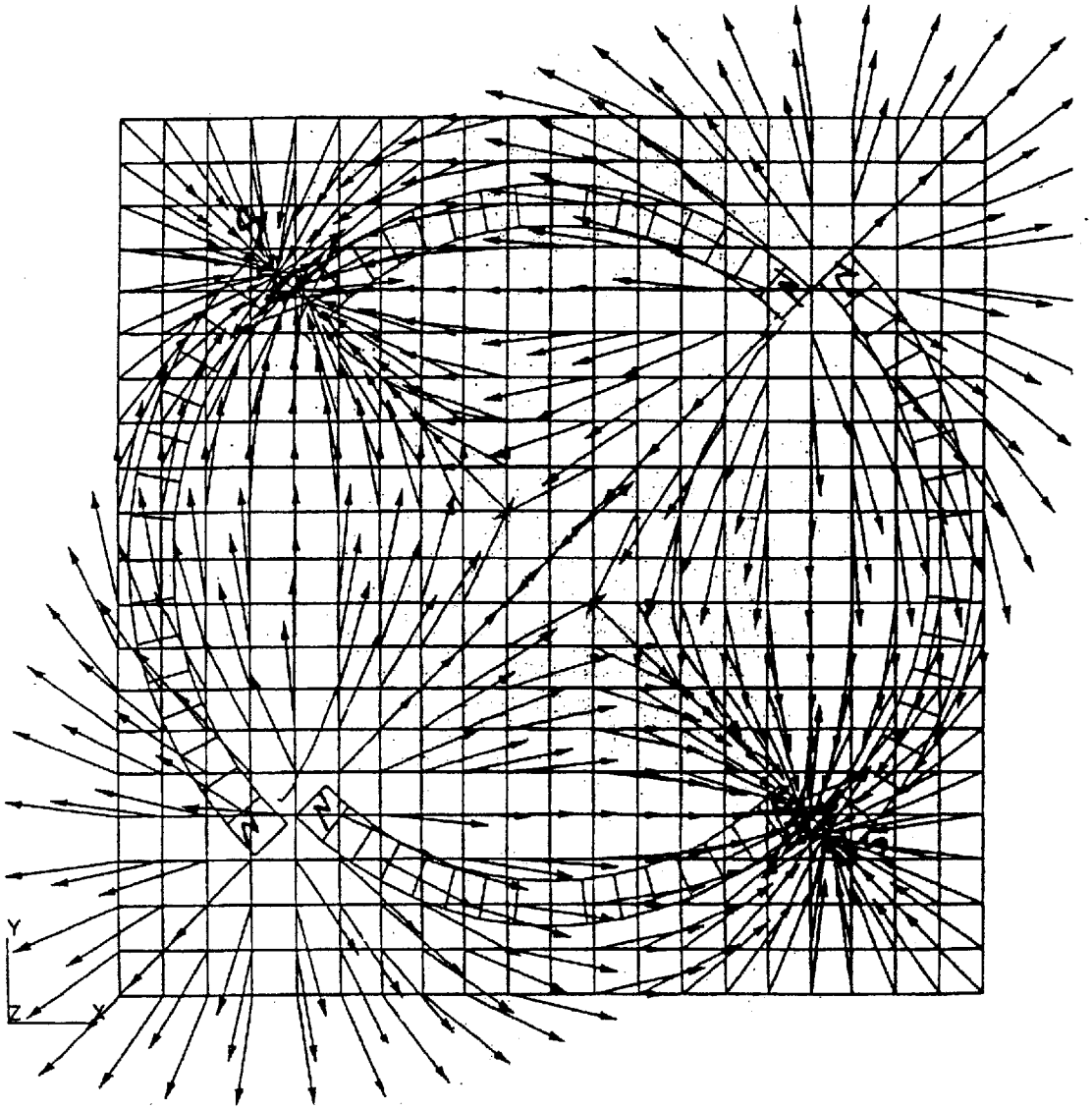

FIG. 9 illustrates four-pole magnet formed inwardly and outwardly, FIG. 11 illustrates, a schematic sectional view of a magnetization state of a section of a color purity and convergence magnet for a color cathode ray tube in accordance with the present invention, FIGS. 12*a* and 12*b* illustrate a graph of a magnetization state of a magnet according to its angle in a circumferential direction, and FIGS. 13*a* through 13*c* illustrate a magnetic field formed according to relative angle adjustment of the inner ring magnet 21 and outer ring magnet 22 thusly magnetized.

In FIG. 11, a condition of obtaining Zero Gauss H at center is as follows. That is, a magnetic field H from a magnetic field source (for example, permanent magnet) to a free space ($\mu$–$\mu_0$) is in inverse proportion to a distance R squared, which is expressed by Equation 1.

$$H \propto \frac{1}{R^2} \tag{1}$$

In addition, in FIG. 11, when $R_0=\alpha R_I$ ($\alpha$>1.0, in genera 1), and $V_0=\beta V_I$ (Herein, $R_I$ is the distance from the polar surface of the inner ring magnet 21 at the center, and $R_0$ is the distance from the polar surface of the outer ring magnet 22 at the center), the polar surface magnetic field $H_I$ of the inner ring magnet 21 and the magnetic field $H_0$ of the polar surface of the outer ring magnet 22 are expressed by Equations 2 and 3, respectively.

$$H_O \propto \frac{1}{Ro^2} M_O V_O \tag{2}$$

$$H_I \propto \frac{1}{R_I^2} M_I V_I \tag{3}$$

In order for the magnetic fields formed by both magnets 21 and 22 to be identical at the center of the neck, when Equations 2 and 3 are made identical, the relation between the amounts of magnetization of the inner ring magnet 21 and the outer ring magnet 22 is expressed by Equation 4.

$$\frac{1}{R_O^2} M_O V_O = \frac{1}{R_I^2} M_I V_I \tag{4}$$

When $R_0=\alpha R_I$ and $V_{0=\beta VI}$ are applied, Equation 5 is obtained as follows.

$$M_O = \frac{\alpha^2}{\beta} M_I \tag{5}$$

Therefore, the magnetic fields formed at the center by both magnets 21 and 22 becomes identical by obtaining the magnetization intensity $M_0$ of the outer ring magnet 22 with respect to the magnetization intensity $M_I$ of the inner ring magnet 21 by $$M_O = \left(\frac{\alpha^2}{\beta}\right) M_I.$$

Actually, as the result that the inner ring magnet 21 and the outer ring magnet 22 are magnetized to their inner surfaces, a magnetization curve as in Table 1 and FIGS. 12*a* and 12*b* can be obtained.

TABLE 1

| | classification | N pole | S pole | N pole | S pole | average | minimum amount of beam movement | maximum amount of beam movement |
|---|---|---|---|---|---|---|---|---|
| 1 | inner ring magnet 21 | 95 | 94 | 74 | 86 | 87.25 | 0.50 mm | 5.0 mm |
| | outer ring magnet 22 | 127 | 123 | 115 | 122 | 121.75 | | |
| 2 | inner ring magnet 21 | 97 | 95 | 76 | 88 | 89 | 0.50 mm | 5.0 mm |
| | outer ring magnet 22 | 128 | 124 | 116 | 122 | 122.5 | | |
| 3 | inner ring magnet 21 | 97 | 96 | 76 | 88 | 89.25 | 0.48 mm | 5.1 mm |
| | outer ring magnet 22 | 126 | 125 | 116 | 123 | 122.5 | | |
| 4 | inner ring magnet 21 | 96 | 96 | 76 | 87 | 88.75 | 0.49 mm | 5.0 mm |
| | outer ring magnet 22 | 129 | 125 | 117 | 124 | 123.5 | | |
| 5 | inner ring magnet 21 | 96 | 94 | 75 | 87 | 88 | 0.50 mm | 5.0 mm |
| | outer ring magnet 22 | 125 | 122 | 114 | 120 | 120.25 | | |

As the result of the magnetic fields in a state of combination of the color purity and convergence magnets 21 and 22 for the color cathode ray tube in accordance with the present invention by assembling the magnets, when the magnetic pole of outer ring magnet 22 and the magnetic pole of the inner ring magnet 21 are identical ($\theta=0$), their magnetizing forces are offset each other, and the resultant minimum magnetic field exerts little influence on electron beams. Namely, the respective amount of movement of three electron beams is less than 0.5 mm.

Figure 1:
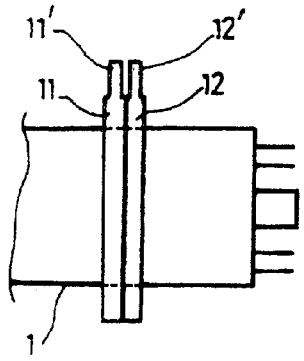
FIG. 1 (PRIOR ART)
FIG. 1 is a front view illustrating an example of a color purity and convergence magnet for a color cathode ray tube in a conventional art.
Figure 2A:
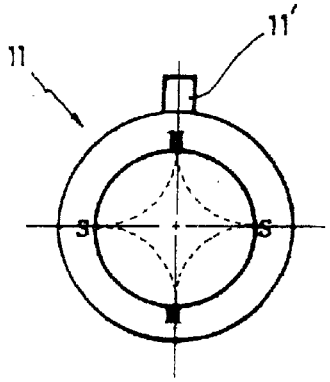
FIG. 2a (PRIOR ART)
FIGS. 2*a* and 2*b* are plan views illustrating a magnetization structure for each magnet of FIG. 1.
Figure 2B:
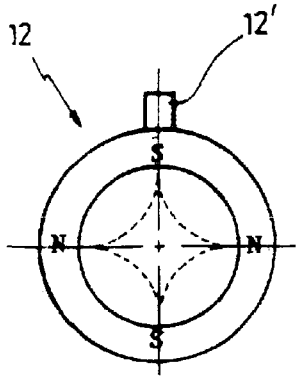
FIG. 2b (PRIOR ART)
Figure 3:
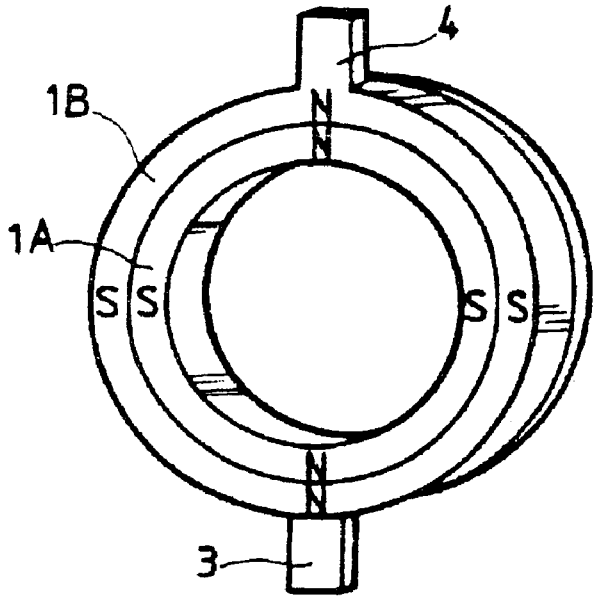
FIG. 3 (PRIOR ART)
FIG. 3 is a perspective view illustrating an example of a beam adjusting apparatus in other conventional art.
Figure 4:
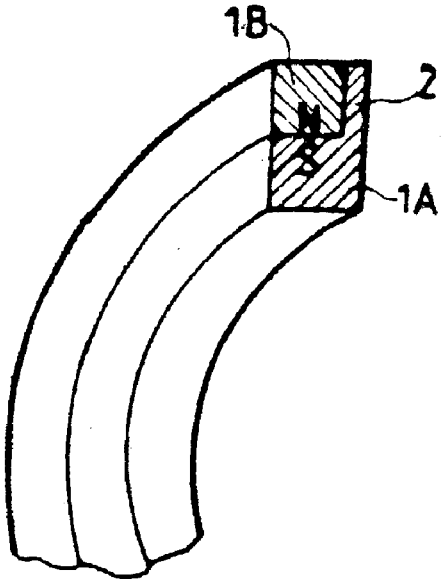
FIG. 4 (PRIOR ART)
FIG. 4 is a partial-sectional perspective view fully illustrating a structure for a section of a beam adjusting apparatus of FIG. 3.
Figure 5A:
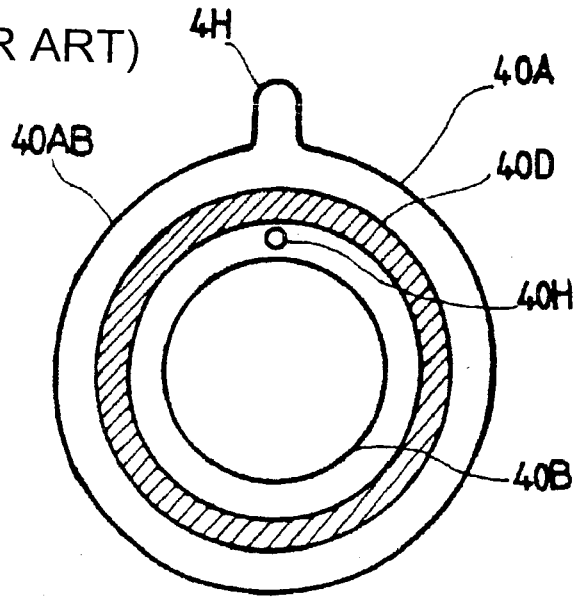
FIG. 5a (PRIOR ART)
FIGS. 5*a* and 5*b* are front view and cross-sectional view respectively of a composite ring magnet as another example of an another conventional art.
Figure 5B:
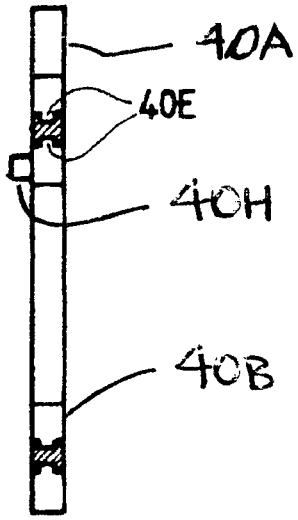
FIG. 5b (PRIOR ART)
Figure 6:
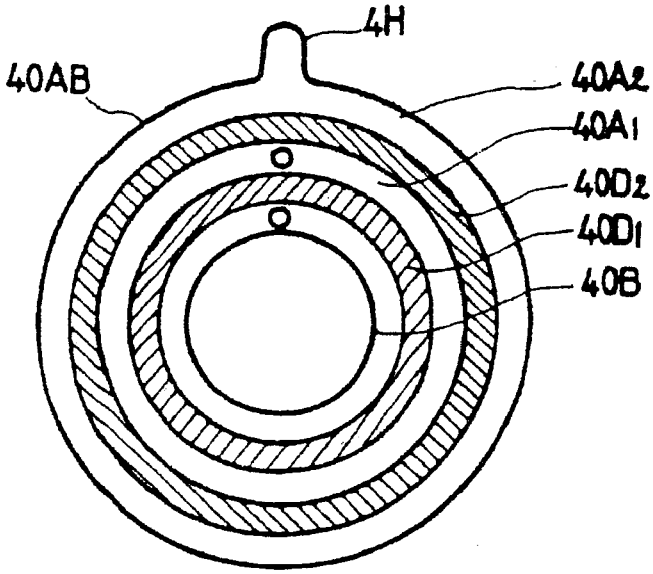
FIG. 6 (PRIOR ART)
FIG. 6 is a side view of a composite ring magnet as another construction of FIGS. 5*a* and 5*b;*
Figure 7A:
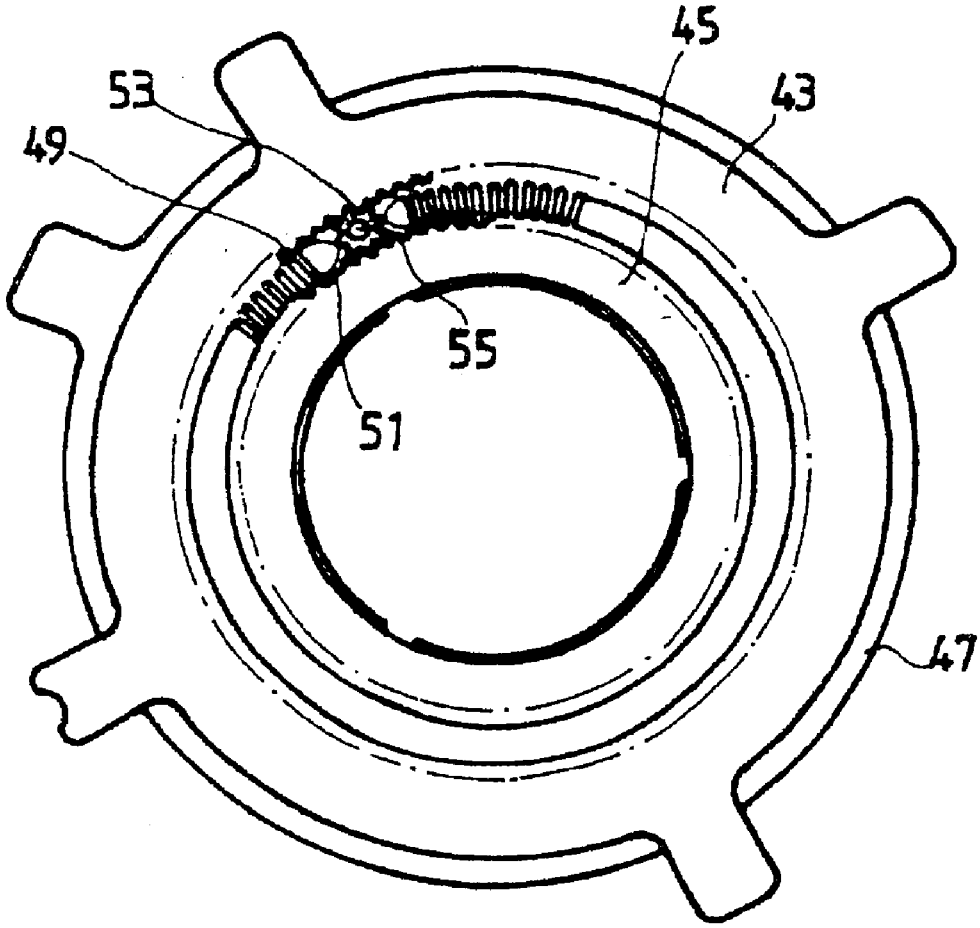
FIG. 7a (PRIOR ART)
FIGS. 7*a* and 7*b* are plan view and cross-sectional view respectively of a support member constituting a magnetic correction apparatus part in a cathode ray tube as example of a still another conventional art.
Figure 7B:
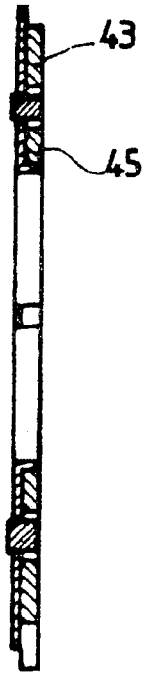
FIG. 7b (PRIOR ART)

In addition, in FIG. 13*b*, when the magnetic poles of the outer and inner ring magnets 21 and 22 are 45 degrees ($\theta=45°$), the strength of the magnetic fields close to the average strength. In FIG. 7*c*, when the magnetic poles of the outer and inner ring magnets 21 and 22 are 90 degrees ($\theta=90°$), the strength of the magnetic fields is the largest, the position of the electron beams can be adjusted as much as needed by adjusting the angle of the inner and outer ring magnets or by overall rotation. That is, in this case, the maximum amount of beam movement is 5.1 mm when the beams are in a magnetization state as in Table 1.

In the case that adjustment is unnecessary as in FIG. 13*a*, it is necessary for the magnetic fields influencing on the electron beams not to be formed. This is made possible by increasing the strength of the magnetic field formed at the outer ring magnet, compared to the inner ring magnet. It is preferable to determine the strength of the inner and outer ring magnets according to their radiuses as described above, in the case that the magnets are magnetized to their respective inner surfaces.

Consequently, the amount of electron beam movement can be fine-adjusted to a minimum or maximum irrespective of the mounting position of the color cathode ray tube, and the minimum magnetic field can be formed to be equal to zero in the interior of the tube. In other words, the magnetic field becomes zero in the case that adjustment is not necessary, thereby not influencing the distortion of the shape of electron beams.

In addition, both magnets are easily magnetized by forming the magnetic field by magnetization to their inner surface, and the forward and backward regions dominated by the color purity and convergence magnet for the color cathode ray tube can be decreased by a structure of vertical arrangement, thereby the workability on the neck portion of the color cathode ray tube is increased. Accordingly, application to a wide angle deflection system becomes easy, and the neck portion can be shortened.

By the construction of the color purity and convergence magnet for the in-line type color cathode ray tube in accordance with the present invention as described above, fine adjustment is possible irrespective of the position of the magnets, by magnetizing the magnets formed in a ring shape to their respective inner surfaces, arranging them on the same surface and decreasing the magnetizing force of the inner ring magnet 21 as compared to the magnetizing force of the outer ring magnet 22. In addition, the influence on the distortion of the shape of electron beams is minimized by making the electron beams experience the minimum magnetic field, and the region dominated by the color purity and convergence magnet for the color cathode ray tube is decreased by the structure of vertical arrangement, thereby increasing the workability in the neck portion of the tube.

What is claimed is:

1. A color purity and convergence magnet for a color cathode ray tube comprising an inner ring magnet and an outer ring magnet being mounted at the outer circumference of a neck portion in the tube and arranged externally and internally in a radial direction on the same surface orthogonal to the tube axis so as to adjust the static characteristics of the color purity and convergence, wherein a magnetizing force of the same number of poles such as two-pole, four-pole and six-pole is formed at the same angle of the circumference, characterized in that:

the inner surface of the inner ring magnet is magnetized; and the magnetizing force of the inner ring magnet is smaller than that of the outer ring magnet in strength.

2. The color purity and convergence magnet of claim 1, wherein the outer ring magnet is magnetized to its inner surface, and the magnetization intensity $M_0$ of the outer ring magnet by $M_0=(\alpha^2/\beta)M_I$ with respect to the magnetization intensity of the inner ring magnet (herein, $\alpha$ is $R_0/R_I$, $\beta$ is $V_0/V_I$, $R_I$ is the internal radius of the inner ring magnet, $R_0$ is the internal radius of the outer ring magnet 22 , $V_I$ is the magnetic volume of the inner ring magnet, and $V_0$ is the magnetic volume of the outer ring magnet).

3. The color purity and convergence magnet of claim 1, wherein an adjusting hand lever of the inner ring magnet is formed to protrude outwardly in a radial direction, being protruded in the axial direction of the tube from one surface vertical to a tube axis of the inner ring magnet; and the adjusting hand lever of the outer ring magnet is formed to protrude from the outer circumferential surface of the outer ring magnet so that it is close to the adjusting hand lever of the inner ring magnet, when combined with the inner ring magnet.

4. The color purity and convergence magnet of claim 1, wherein an amount of electron beam movement is less than 0.5 mm, when the outer ring magnet and inner ring magnet are arranged so that magnetizing force of the opposite polarity corresponds towards the radial direction.

* * * * *